US005934747A

United States Patent [19]

Garland

[11] Patent Number: 5,934,747

[45] Date of Patent: Aug. 10, 1999

[54] CONVERTIBLE ACTIVITY CENTER

[75] Inventor: Thomas A. Garland, Jamestown, R.I.

[73] Assignee: Princeton Innovations, Inc., Jamestown, R.I.

[21] Appl. No.: 08/949,200

[22] Filed: Oct. 10, 1997

[51] Int. Cl.[6] ..... A47B 83/02

[52] U.S. Cl. ..... 297/136; 472/103; 297/DIG. 11; 297/440.22

[58] Field of Search ..... 297/136, 137, 297/440.22, 119, DIG. 11, 5; 472/135, 95, 103, 104

[56] References Cited

U.S. PATENT DOCUMENTS

| | | | |
|---|---|---|---|
| 1,059,908 | 4/1913 | Root | 297/136 |
| 2,386,721 | 10/1945 | Sedita | 297/136 |
| 2,551,999 | 5/1951 | Ditty, Sr. | 297/136 |
| 3,164,351 | 1/1965 | Rembowski | 248/188.5 |
| 3,811,455 | 5/1974 | Thur | 248/188.5 X |
| 5,584,531 | 12/1996 | Bowman | 297/136 X |
| 5,688,211 | 11/1997 | Myers | 297/5 X |
| 5,700,201 | 12/1997 | Bellows et al. | 472/103 |
| 5,720,522 | 2/1998 | Habeck | 248/188.5 X |

OTHER PUBLICATIONS

Play It Safe Exercise and Activity Center, Summer Infant Products, Inc.
Exercisers, Cosco 1996 Catalog, p. 19.
Exersaucer, Evenflo 1996 Catalog, p. 19.
Stationary Entertainers, Graco 1996 Catalog.
Standard Old Walker.

*Primary Examiner*—Peter M. Cuomo
*Assistant Examiner*—Stephen Vu
*Attorney, Agent, or Firm*—Barlow, Josephs & Holmes, Ltd.

[57] ABSTRACT

A convertible activity center is convertible between a bouncer-type seat configuration and a play table configuration. The activity center includes a tray-shaped body portion having a planar play surface and a central opening therein, and a plurality of adjustable legs which are pivotably mounted to the body portion for supporting the body potion above a supporting surface. A seat assembly is removably mounted within the central opening to provide the bouncer-type seat configuration. The seat assembly is rotatable relative to the body portion for added play value. The leg assemblies are adjustable in height to provide different height settings as the child grows and further include an internal a spring arrangement which allows the body portion to resiliently bounce relative to the leg portions. A locking mechanism is provided for selectively locking out the bouncing feature. When the child reaches standing or walking stage of development, the bouncer can be converted into a table configuration by removing the seat assembly from the central opening and mounting an insert within the central opening to provide a substantially continuous play surface on the top of the body portion. In the table configuration, the bouncing feature would be locked out to provide a stable play surface, while the legs can be adjusted to different height levels depending on the needs of the particular child using the table.

2 Claims, 11 Drawing Sheets

CONVERTIBLE ACTIVITY CENTER

BACKGROUND AND SUMMARY OF THE INVENTION

The instant invention relates to children's activity centers, and more particularly to an activity center which is convertible between a bouncer-type activity center, and a stationary play table.

Children's activity centers have heretofore been known in the art. In this regard, one type of well known activity center comprises a walker toy including a tray, a seat in the middle of the tray and wheels rotatably mounted to the assembly. Such walker-type devices have been popular for many years. However, due to the obvious hazards of having a child freely mobilized on wheels, the recent trend in activity centers has been to create devices which do not have wheels so as to restrict the movement of a child seated therein. In this regard, a variety of different stationary play centers have also been known in the art. These stationary devices are typically very similar to the prior walker devices, with the exception that they are mounted on legs rather than wheels, or alternatively they are mounted on rocking assemblies which provide for rocking movement, yet do not allow mobility. While each of the prior art devices is functional and effective for its intended purpose, there is an ongoing consumer desire for new and improved activity center products which provide new functionality.

The instant invention provides a convertible activity center which is convertible between a bouncer-type stationary seat configuration and a play table configuration. The activity center includes a tray-shaped body portion having a generally planar play surface and a central opening therein, and a plurality of adjustable leg assemblies which are pivotably mounted to the body portion for supporting the body portion in a stationary position on a supporting surface. The activity center further includes a removable seat assembly which can be selectively mounted within the central opening to provide the bouncer-type seat configuration. The seat assembly and body portion are constructed so that the seat assembly is rotatable relative to the body portion for added play value, and such that a child seated in the seat can reach and play with toys placed on the surrounding play surface. The leg assemblies include upper and lower telescoping portions which are adjustable in height to provide different height settings as the child grows. Furthermore, to provide a bouncing action, the leg assemblies further include a telescoping foot portion and an internal spring arrangement captured between the foot portion and the lower leg portion which allows the upper portions of the leg and the body portion to resiliently bounce relative to the foot portion which engages the floor. A locking mechanism is provided on the legs for selectively locking out the bouncing feature. The locking mechanism extends between the lower leg portion and the foot portion to prevent movement of the lower leg portion relative to the foot portion. When the child reaches a standing or walking stage of development, the activity center can be converted into a table configuration by removing the seat assembly from the central opening and mounting a planar table top insert within the central opening to provide a continuous planar play surface on the top of the body portion. In the play table configuration, the bouncing feature would be locked out on the legs to provide a stable play surface, while the legs can be adjusted to different height levels depending on the needs of the particular child using the table. For shipping and storage of the assembly, the leg assemblies are pivotably movable to a storage position beneath the play surface. In this regard, the leg assemblies are mounted to the body portion in offset relation so that the leg assemblies are received in nested co-planar relation adjacent to the underside of the play surface when pivoted to the storage position.

Accordingly, among the objects of the instant invention are: the provision of a children's activity center which is convertible between a bouncer-type activity center and a play table; the provision of such an activity center wherein the body portion includes a planar play surface and a central opening therein; the provision of such an activity center wherein a removable seat assembly is rotatably received in the central opening to form a seated bouncer-type activity center; the provision of such an activity center further comprising a table top insert which is alternatively received in the central opening of the body portion to form an activity table; the provision of such an activity center which is adjustable in height in either the bouncer configuration or the table configuration; the provision of such an activity center wherein the body portion is resiliently movable relative to the support legs to provide a bouncing action in the bouncer configuration; the provision of such an activity center further including a locking mechanism to selectively lock or unlock the bouncing action in either the bouncer configuration or the table configuration; and the provision of such an activity center wherein the legs are pivotably mounted to the body portion in offset relation so that the leg assemblies are received in nested relation adjacent to the underside of the play surface of the body portion.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE PREFERRED EMBODIMENT

Figure 3:
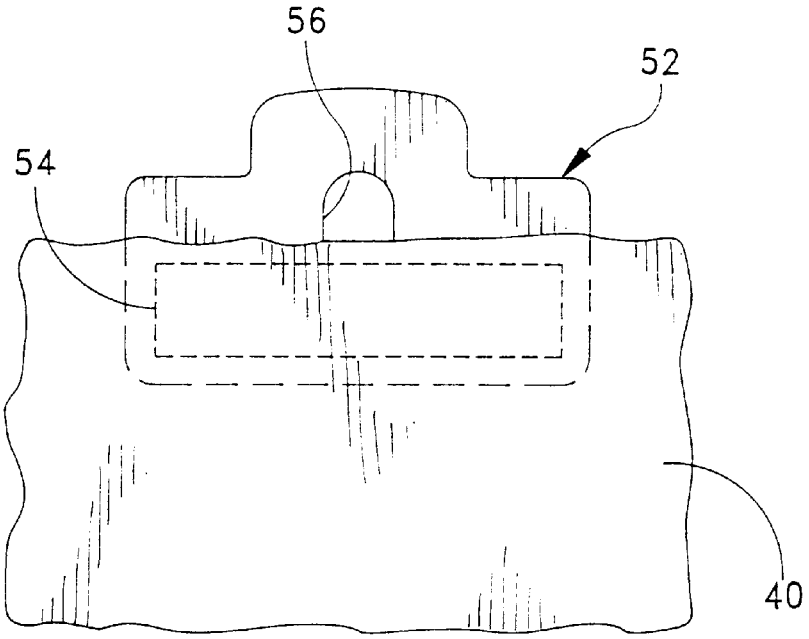
FIG. 3 is a cross-sectional view of the fabric tabs as taken along line 3—3 of FIG. 2.
Figure 4:
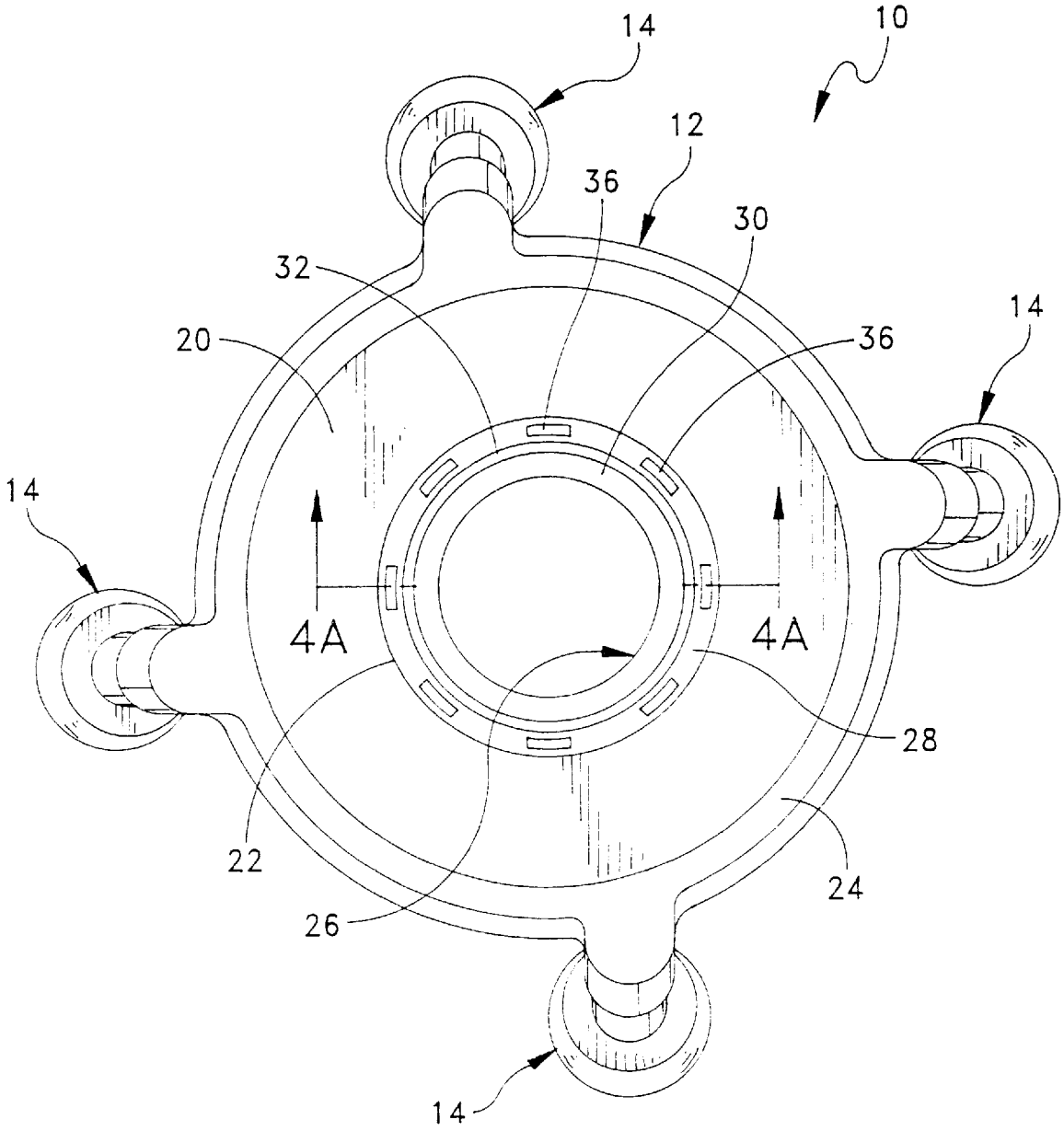
FIG. 4 is a top view of the activity center with the seat assembly removed.
Figure 5:
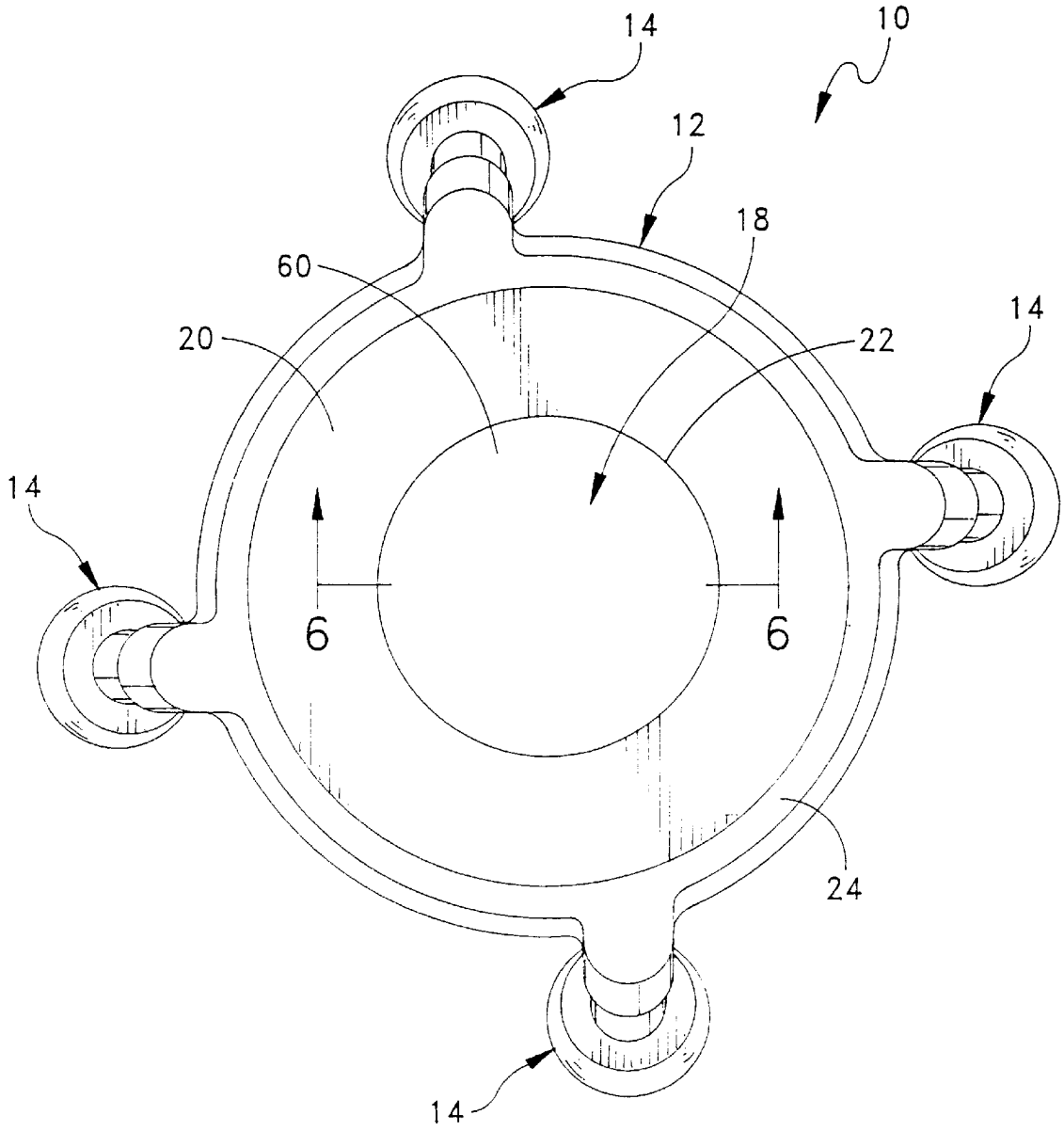
FIG. 5 is a top view of the activity center with the table top insert received in the central opening of the body portion.
Figure 6:
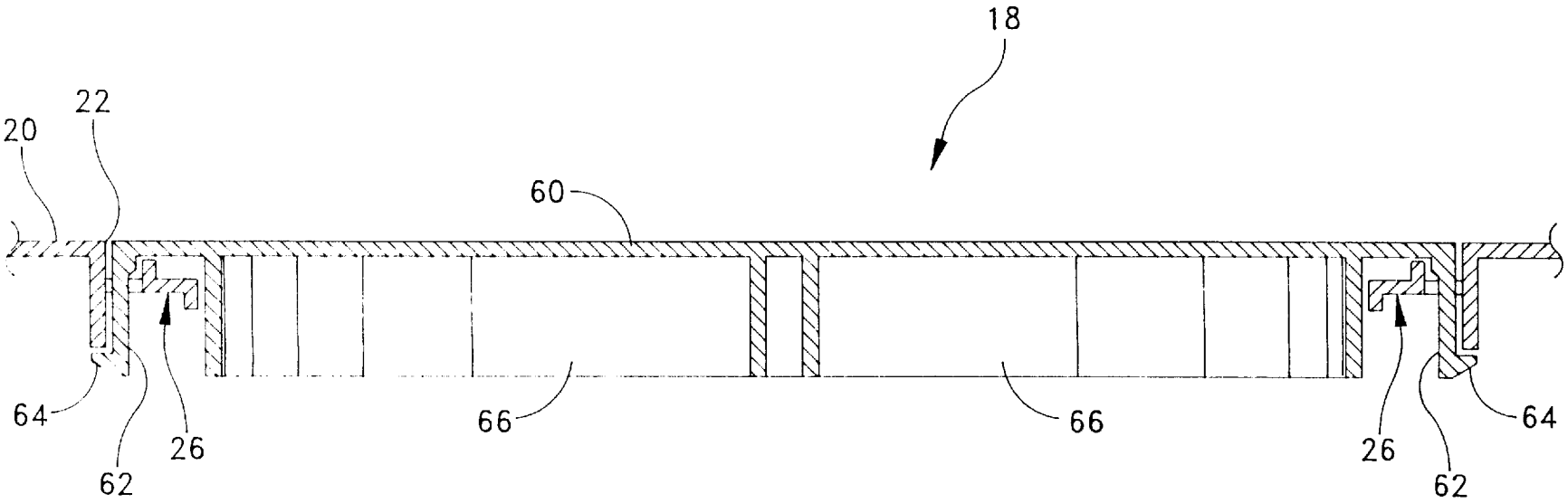
FIG. 6 is a cross-sectional view thereof as taken along line 6—6 of FIG. 5.
Figure 7:
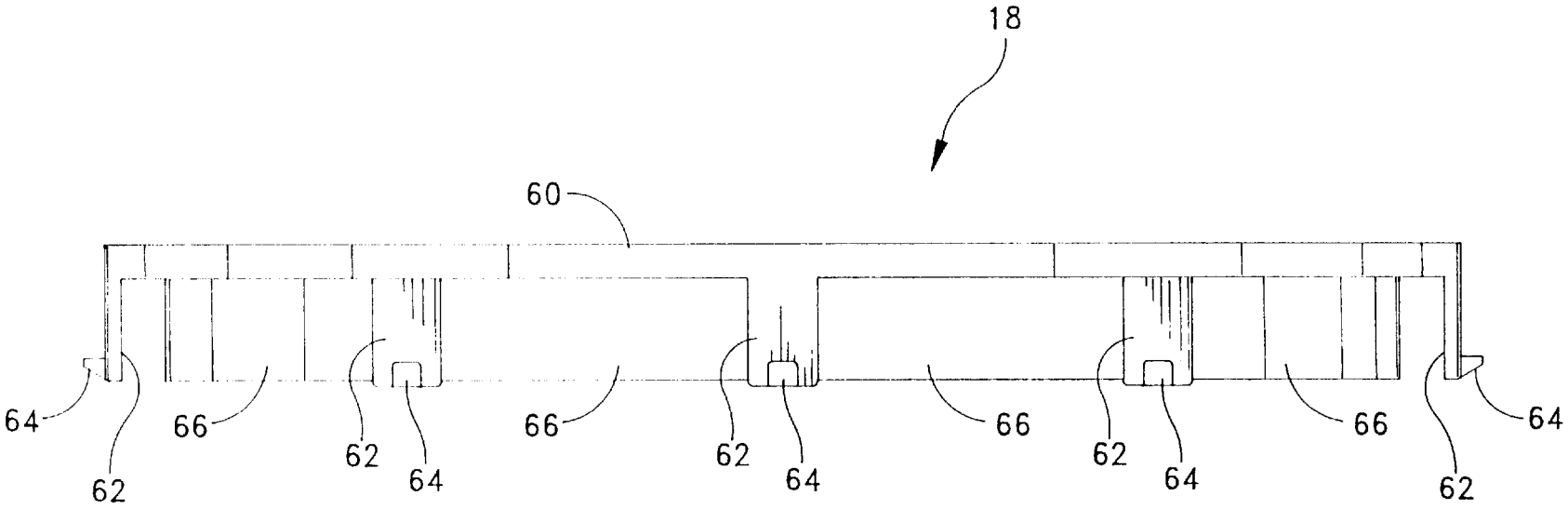
FIG. 7 is a side view of the table top insert.

Referring now to the drawings, the convertible activity center of the instant invention is illustrated and generally indicated at 10 in FIGS. 1–10. As will hereinafter be more fully described, the activity center 10 is convertible between a seated bouncer-type configuration (FIGS. 1–3) and play table configuration (FIGS. 5–7).

The activity center 10 comprises a tray-shaped body portion generally indicated at 12, a plurality of leg assemblies generally indicated at 14 for supporting the body portion 12 above a supporting surface, a seat assembly generally indicated at 16 for use in the bouncer configuration, and a table top insert generally indicated at 18 for use in the play table configuration. Unless otherwise specifically stated herein, it is to be understood that each of the described elements is preferably molded from a suitable polymer material. Alternatively, the elements could be fabricated from other suitable child safe materials.

Figure 4A:
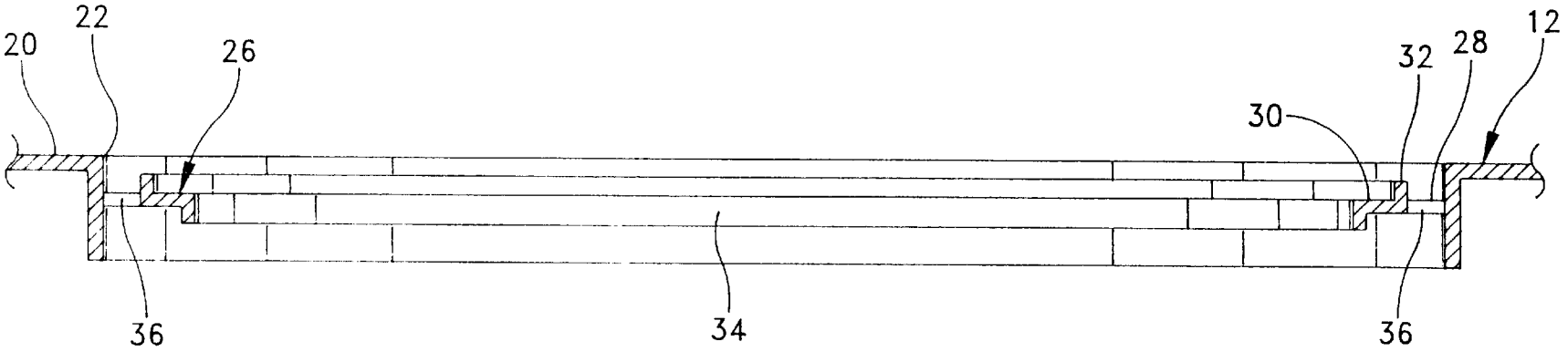
FIG. 4A is a cross-sectional view thereof as taken along line 4A—4A of FIG. 4.

Referring to FIG. 4, the body portion 12 is generally circular in shape and includes a generally planar play surface 20 having a central circular opening 22 therein. The outer edge of the play surface 20 includes a retaining lip 24 which acts to prevent toys placed on the play surface 20 from being easily pushed off the outer edge of the play surface during use. The inner edge of the play surface 20 is provided with a support ledge generally indicated at 26 which is operative for supporting either the seat assembly 16, or table top insert 18, during use. Referring to FIGS. 4 and 4A, the support ledge 26 includes an outer shoulder 28 and an inner shoulder 30 which are separated by a upwardly extending ridge 32. The inner edge of the inner shoulder 30 turns downwardly to form an inner side wall 34, and the outer shoulder 28 includes a plurality of circumferentially spaced openings 36 which are intended to receive resilient mounting tabs on the table top insert 18.

Figure 1:
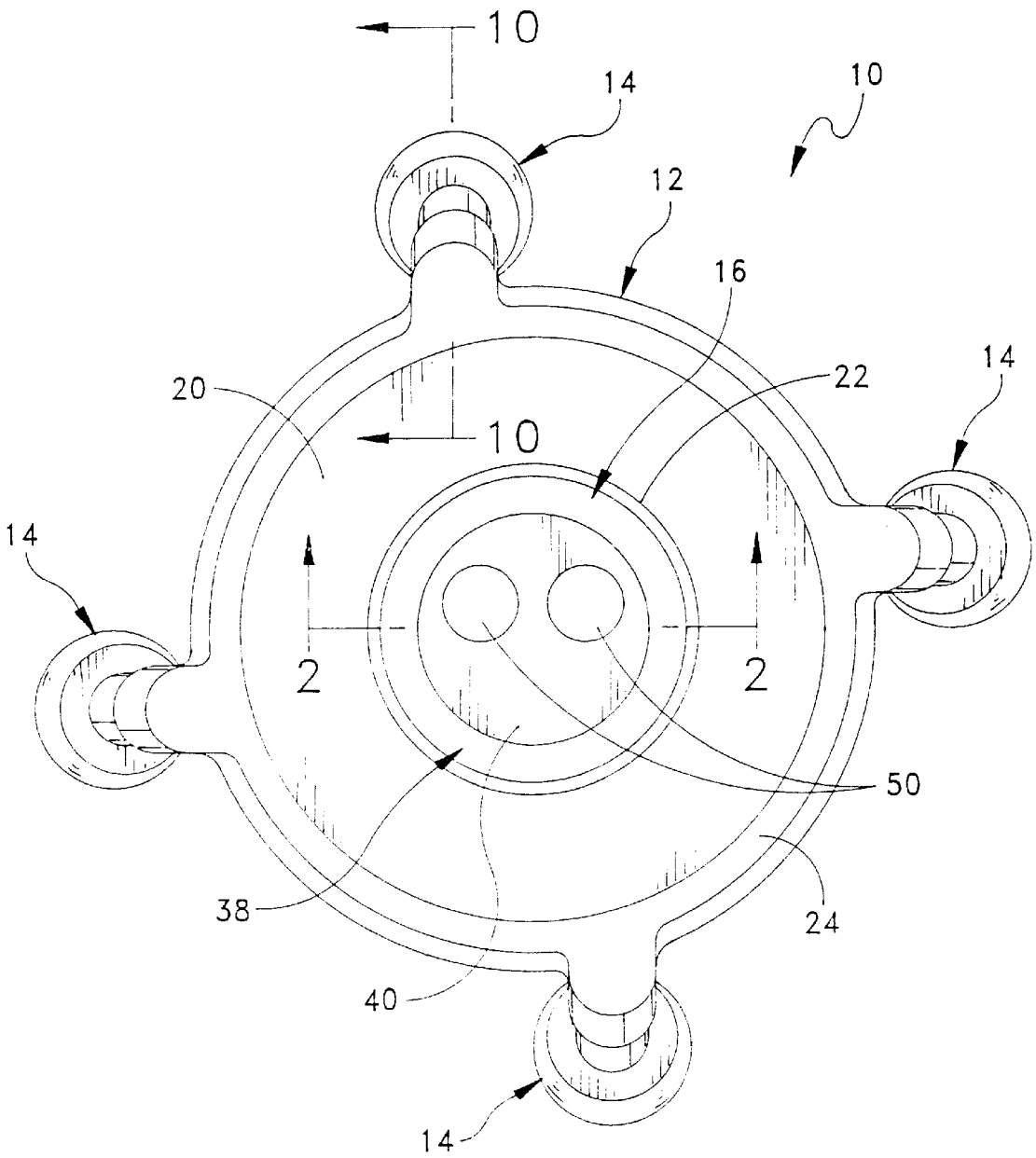
FIG. 1 is a top view of the activity center with a seat assembly received in the central opening of the body portion.
Figure 2:
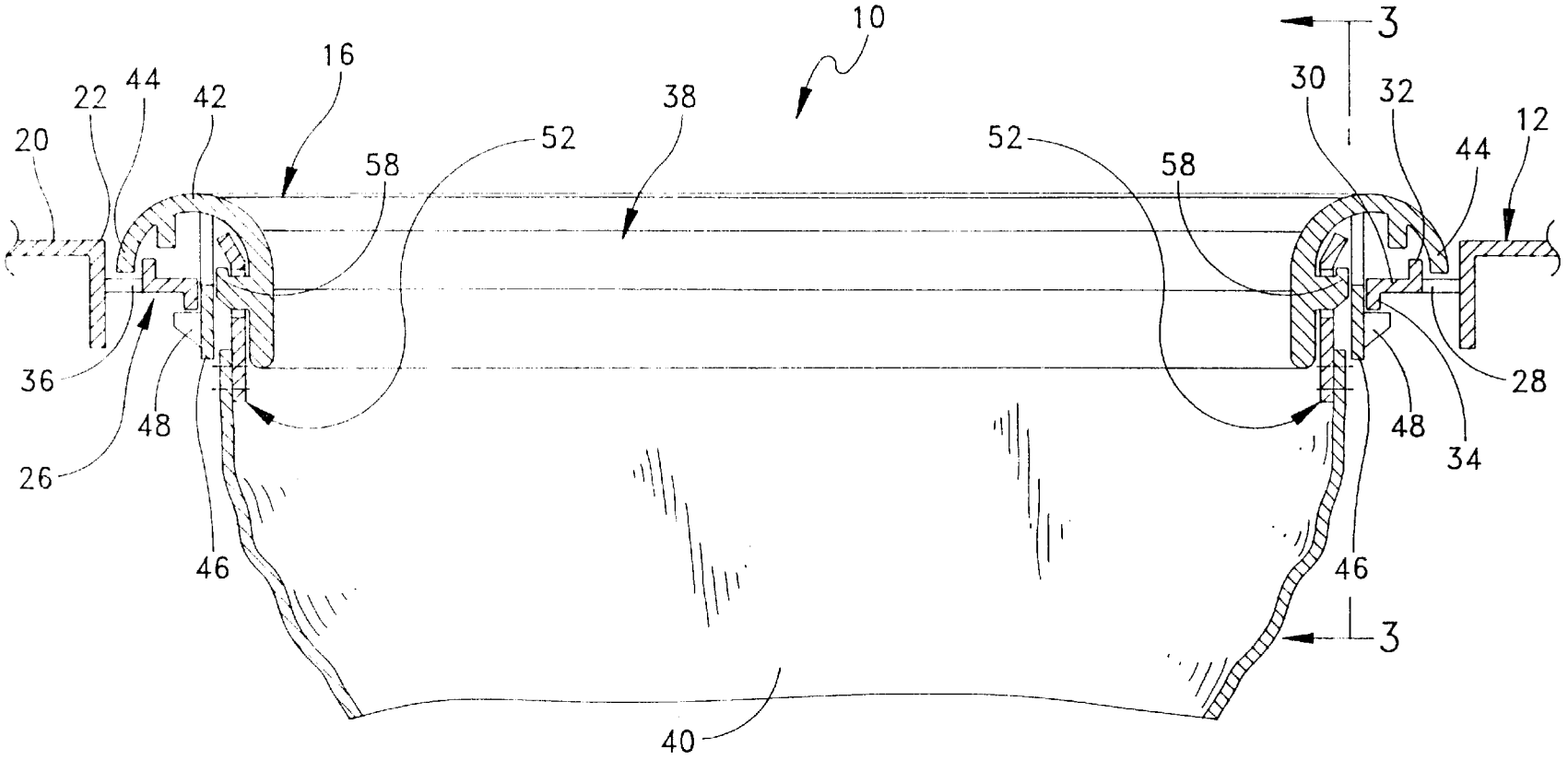
FIG. 2 is a cross-sectional view thereof as taken along line 2—2 of FIG. 1.
Figure 3A:
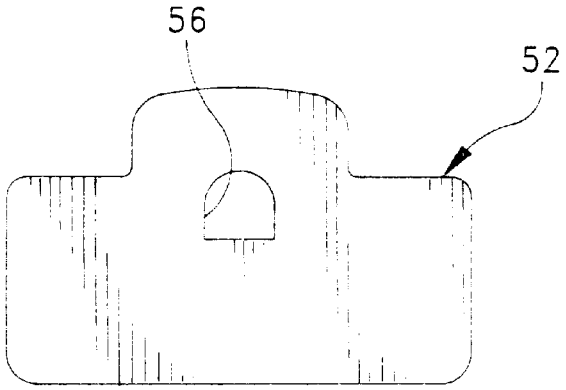
FIG. 3A is a plan view of the fabric tab.

Referring now to FIGS. 1–4, the seat assembly 16 is assembled with the body portion 12 in the central opening 22 of the play surface 20 for use of the activity center 10 in the bouncer configuration. The seat assembly 16 comprises an annular mounting ring generally indicated at 38, and a fabric seat 40 attached to the mounting ring 38. The mounting ring 38, as shown in cross-section in FIG. 2, comprises an inverted generally U-shaped wall 42 having a smooth outer facing surface, and an inwardly facing surface. In use, the outer terminal edge 44 of the mounting ring 38 is received within central opening 22 of the play surface 20 onto the outer shoulder 28 of the support ledge 26. The outer edge 44 rests on top of the outer shoulder 28 and the arrangement is such that the mounting ring 38 is slidably rotatable with respect to the support ledge 26. In order to maintain the mounting ring 38 in assembled relation with the body portion 12, the inner surface of the mounting ring 38 includes a plurality of downwardly extending, circumferentially spaced, spring tabs 46 having detents 48 formed thereon. The detents 48 of spring tabs 46 are snap engaged with the downwardly turned inner side wall 34 of the support ledge 26 to prevent the mounting ring 38 from being accidentally disengaged from the body portion 12. It can be appreciated that the spring tabs 46 prevent upward movement of the mounting ring 38 from the body portion 12 without interfering with rotation of the mounting ring 38 relative to the body portion 12. The spring tabs 46 also provide the ability to easily remove the mounting ring 38 from the body portion 12 by simply depressing the spring tabs 46 inwardly to disengage the detents 48 from the inner side wall 34 of the support ledge 26. The fabric seat 40 comprises a cup-shaped arrangement of fabric having two leg holes 50 (FIG. 1) formed therein for receiving the legs of a child. Referring to FIGS. 2, 3 and 3A, the upper edge of the fabric seat is releasably mounted to the mounting ring 38 by a plurality of circumferentially spaced plastic tabs 52 secured to the upper edge of the fabric seat 40. The tabs 52 are generally rectangular in configuration and are secured to the fabric seat 40 by means of stitching 54 (shown in broken line in FIG. 3) which passes through the fabric and tabs. The tabs 52 further includes a central opening 56 therein which is releasably received over a corresponding detent 58 on the inwardly facing surface of the mounting ring wall 42. In this regard, the rear surface of the mounting tab 46 normally rests against the outer edge of the detent 58 to form a spring lock with the detent 58 to prevent the fabric tabs 52 from becoming disassembled from the mounting ring 38. It is also noted that the tabs 52 could be fashioned in the form of a continuous strip extending around the upper edge of the fabric. Such a construction would facilitate proper spacing of the tabs during manufacturing.

In use, the seat assembly 16 is assembled with the body portion 12 simply by positioning the seat assembly 16 within the central opening 22 and pressing downwardly until the spring tabs 46 snap engage with the support ledge 26. The seat assembly 16 is thereafter operable for rotatably supporting a child therein.

Referring now to FIGS. 5–7, the activity center 10 can be converted to a play table configuration by removing the seat assembly 16, and inserting the table top insert 18 into the central opening 22 of the play surface 20. The insert 18 comprises a circular body portion 60, and a plurality of circumferentially spaced spring tabs 62 extending downwardly from the outer peripheral edge thereof. The spring tabs 62 include a detent 64 for engagement with the support ledge 26 of the body portion 12. More specifically, the insert 18 is assembled with the body portion 12 by orienting the spring tabs 62 with the openings 36 in the outer shoulder portion 28 of the support ledge 26, and pressing the insert 18 downwardly until the spring tabs 62 snap engage with the inner edge of the central opening 22. Once assembled with the body portion 12, the insert 18 cooperates with the play surface 20 to form a substantially continuous planar table surface. The insert 18 further includes a plurality of reinforcing ribs 66 on the underside thereof to provide stability to the insert 18.

Figure 8:
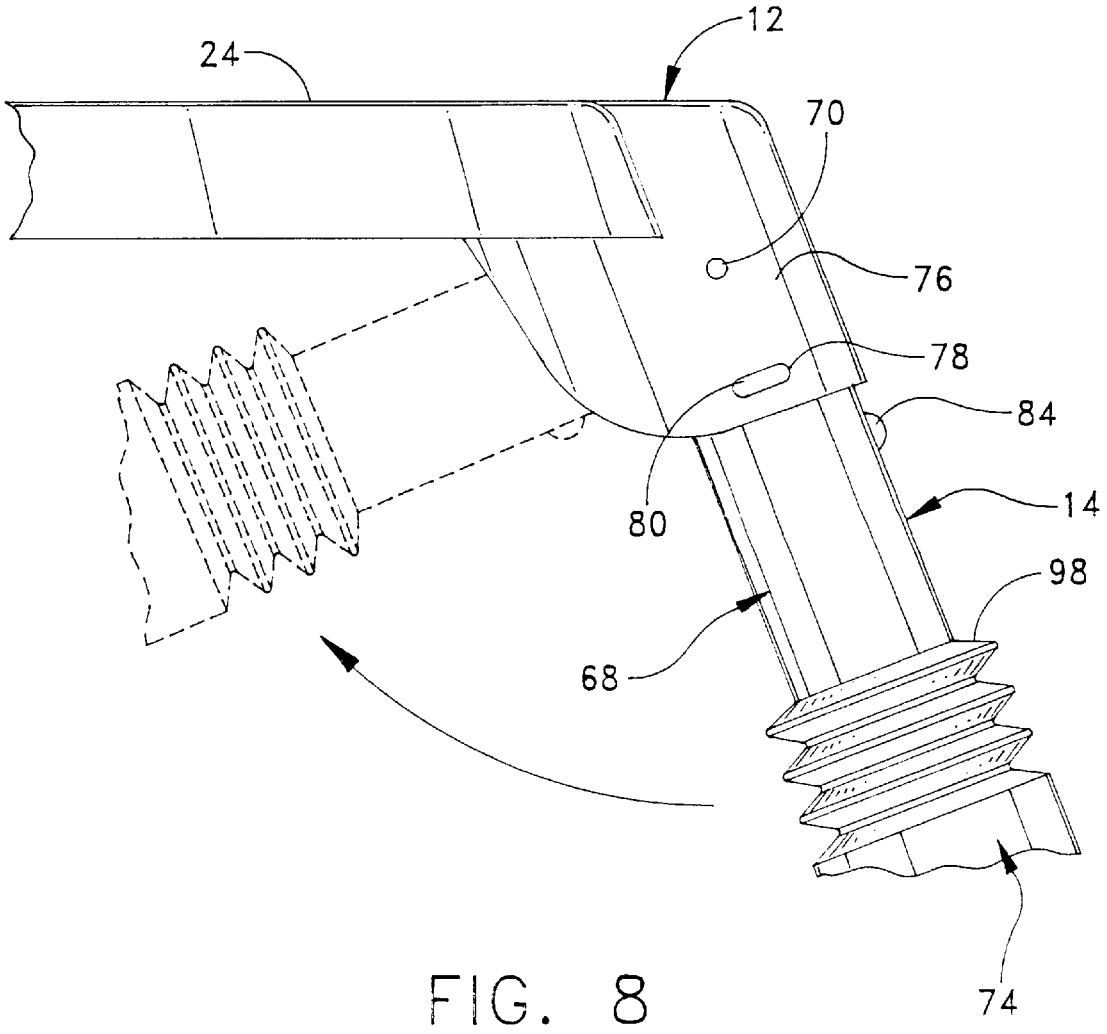
FIG. 8 is a side view of the activity center showing pivoting movement of one of the legs to the storage position.
Figure 9:
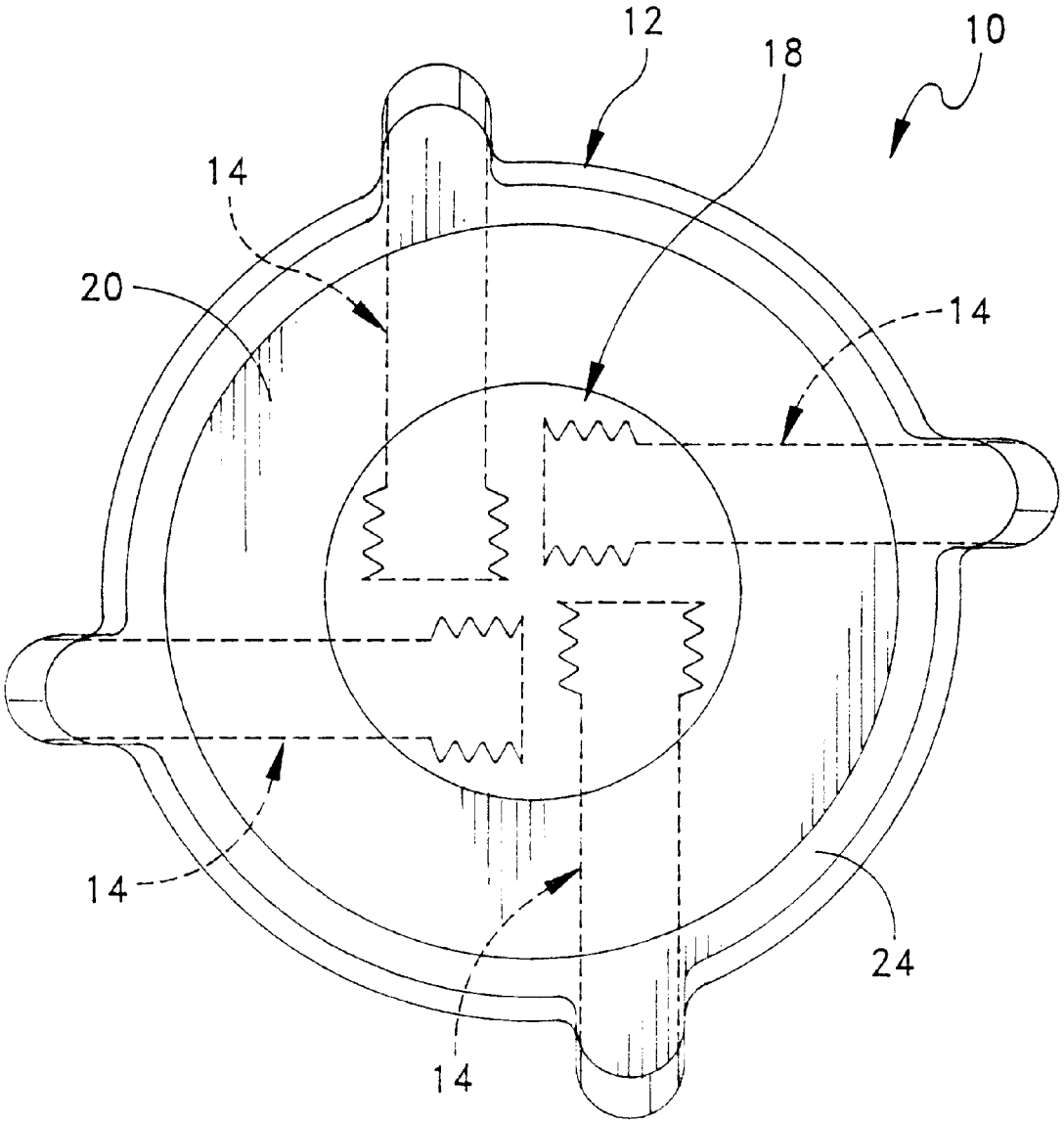
FIG. 9 is a top view showing the legs in broken lines in the storage position.
Figure 10:
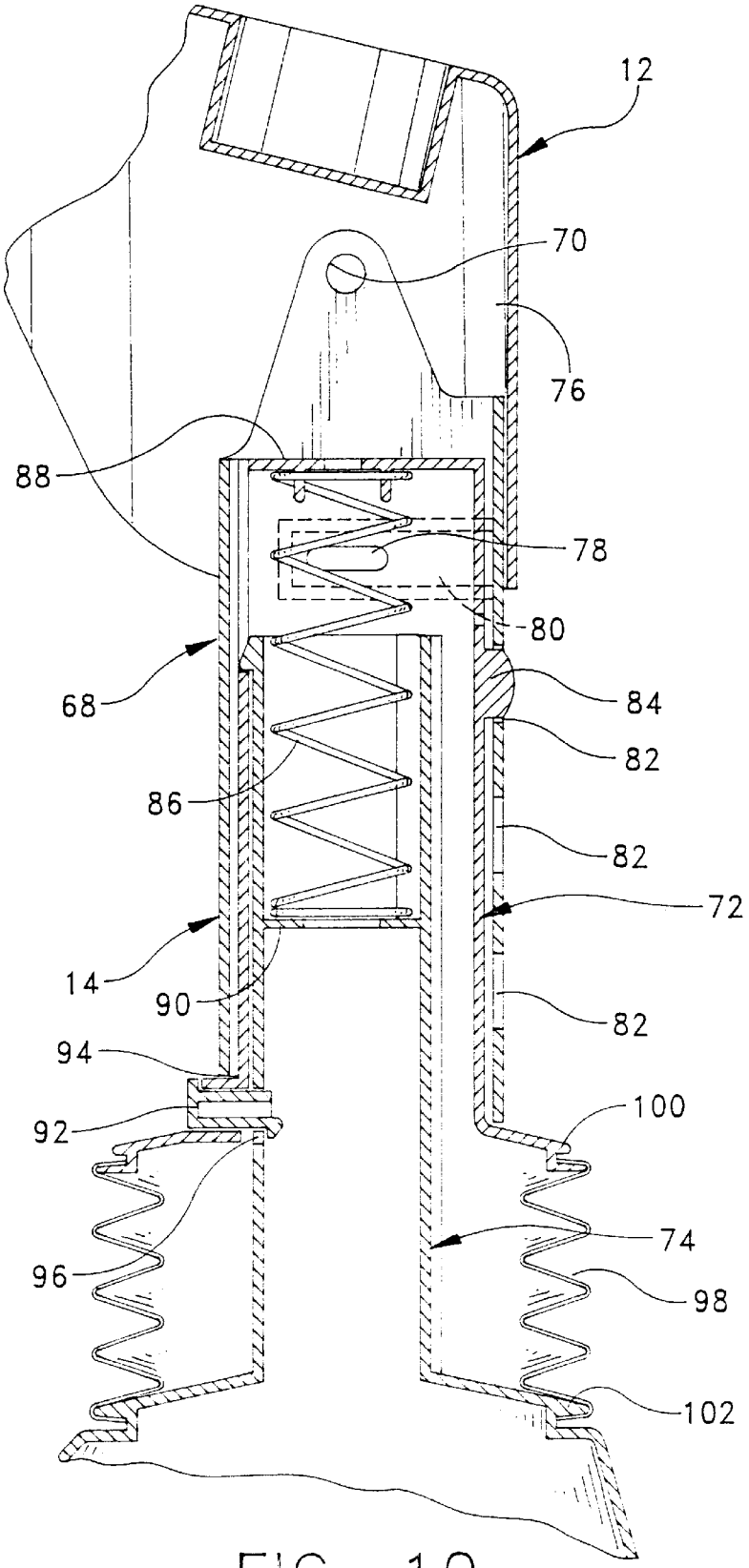
FIG. 10 is a cross-sectional view of the leg assembly as taken along line 10—10 of FIG. 1.

Turning now to FIGS. 8–10, the leg assemblies 14 are operative for providing height adjustment in both the bouncer and play table configurations, and a bouncing action in the bouncer configuration. Each of the leg assemblies 14 comprises a tubular upper leg portion generally indicated at 68 which is pivotably connected to the body portion by pivot pins 70, a tubular lower leg portion generally indicated at 72 telescopically mounted within the upper leg portion 68, and a foot portion generally indicated at 74 telescopically mounted within the lower leg portion 72. Each of the leg assemblies 14 is identical, and therefore, the following description will proceed with reference to only a single leg assembly. The upper leg portion 68 is pivotably connected to a respective leg formation 76 on body portion 12 such that the entire leg assembly 14 is movable between an operative position wherein the leg assembly 14 extends downwardly and outwardly from the body portion 12 (FIG. 8—solid lines), and a storage position (FIG. 9) wherein the leg assembly 14 is received in closely spaced parallel relation to the underside of the play surface 20 of the body portion 12. It is noted that the broken line representation in FIG. 8 shows the leg assembly 14 in a partially folded position, and does not represent the fully closed storage position of the legs. The leg assembly 14 is locked in the open and operative position by means of a locking arrangement comprising a slot 78 in the respective leg formation of the body portion, and a corresponding spring tab 80 integrally formed in the outer surface upper leg portion 68.

In order to provide adequate storage space for the legs 14 beneath the body portion 12, the leg assemblies 14 are mounted to the body portion 12 in offset relation so that leg assemblies 14 can be received in nested relation adjacent to the underside of the play surface of the body portion (FIG. 9). In other words, the leg assemblies 14 are mounted so that they pivot in a line which is in spaced parallel relation to a centerline of the body portion 12.

To provide the noted height adjustment capability, a locking arrangement is provided for selectively locking the upper and lower leg portions 68, 72 in a plurality of predetermined height positions, and in this regard, the locking arrangement comprises a plurality of vertically spaced slots 82 in the upper leg portion 68, and a corresponding spring tab 84 formed in the lower leg portion 72. The spring tab 84 is selectively receivable in any of the three spaced slots 82 for selectively fixing the height of the activity center 10 in one of the predetermined positions.

To provide the noted bouncing action, the leg assemblies 14 include a coil spring 86 which is captured between an upper wall 88 of the lower leg portion 72 and a central retaining wall 90 located within the foot portion 74 for normally biasing the foot portion 74 to an outwardly extended position relative to the upper and lower leg portions 68, 72. In this regard, the spring 86 provides a bouncing action of the body portion 12 relative to the foot portion 74. The bouncing action can be selectively disabled or locked out by a locking pin 92 which selectively prevents or allows relative movement of the lower leg portion 72 relative to the foot portion 74. The locking pin 92 extends through aligned openings 94, 96 respectively in the lower leg portion 72 and foot portion 74. When the locking pin 92 is depressed inwardly, the pin engages the foot portion 74 and prevents movement of the foot portion 74 relative to the lower leg portion 72, and when the locking pin 92 is pulled outwardly, the locking pin 92 is disengaged from the foot portion 74 thereby allowing movement relative to the lower leg portion 72.

The leg assemblies 14 still further include a bellows-style boot 98 extending between a collar 100 on the lower leg portion 72 and a collar 102 of the foot portion 74 to conceal the open space between the lower leg portion 72 and the foot portion 74.

It can therefore be seen that the instant invention provides a unique and effective convertible activity center 10 which is easily converted between a seated bouncer configuration and a play table configuration. The removable seat assembly 16 and table top insert 18 are easily interchangeable for quick conversion from one mode to the other. The seat fabric 40 provides a unique arrangement wherein the fabric does not wrap around the plastic seat thereby saving material and reducing the cost of fabrication. The multi-functional leg assemblies 14 provide height adjustment in both configurations while also providing a selective bouncing feature in the seat configuration. Furthermore, the offset pivoting connection of the legs 14 to the body portion 12 allows longer legs to fold within a given area. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible activity center comprising:

a body portion having a generally planar play surface, said play surface having a central opening therein;

at least one leg assembly connected to the body portion for supporting the body portion above a supporting surface;

a seat assembly which is removably mountable within the central opening in the play surface, said seat assembly and said body portion cooperating to form a bouncer-type configuration of the activity center when said seat assembly is mounted therein; and an insert which is removably mountable within the central opening in the play surface of the body portion when said seat assembly is removed, said insert and said body portion cooperating to form an alternate table configuration having a substantially continuous play surface when said insert is mounted therein, said at least one leg assembly comprising a tubular upper leg portion pivotably connected to the body portion, and a tubular lower leg portion telescopically mounted within the upper leg portion, said lower leg being slidably movable relative to the upper leg portion for adjusting a height thereof, said at least one leg assembly further comprising a locking means for selectively locking said upper and lower leg portions in a plurality of different height positions, said at least one leg assembly further comprising a foot portion telescopically mounted within the lower leg portion, said foot portion being slidably movable relative to the lower leg portion, said at least one leg assembly further comprising spring means captured between interior portions of the lower leg portion and the foot portion for normally biasing the foot portion to an extended position and providing a bouncing action of the lower leg portion relative to the foot portion, said at least one leg assembly still further comprising a locking means for selectively preventing or allowing relative bouncing movement of the lower leg portion relative to the foot portion.

2. A convertible activity center comprising:

a body portion having a generally planar play surface, said play surface having a central opening therein;

a plurality of leg assemblies pivotably mounted to the body portion to the body portion for supporting the body portion above a supporting surface, said plurality of leg assemblies being mounted to the body portion in offset relation such that the leg assemblies are received in nested relation adjacent to an underside of the play surface of the body portion, each of said leg assemblies comprising a tubular upper leg portion pivotably connected to the body portion, and a tubular lower leg portion telescopically mounted within the upper leg portion, said lower leg being slidably movable relative to the upper leg portion for adjusting a height thereof, said leg assemblies further comprising a locking means for selectively locking said upper and lower leg portions in a plurality of different height positions, said leg assemblies further comprising a foot portion telescopically mounted within the lower leg portion, said foot portion being slidably movable relative to the lower leg portion, said leg assemblies further comprising spring means captured between interior portions of the lower leg portion and the foot portion for normally biasing the foot portion to an extended position and providing a bouncing action of the lower leg portion relative to the foot portion, said leg assemblies still further comprising a locking means for selectively preventing or allowing relative bouncing movement of the lower leg portion relative to the foot portion;

a seat assembly which is removably mountable within the central opening in the play surface, said seat assembly and said body portion cooperating to form a bouncer-type configuration of the activity center when said seat assembly is mounted therein; and an insert which is removably mountable within the central opening in the play surface of the body portion when the seat assembly is removed, said insert and said body portion cooperating to form an alternate table configuration having a substantially continuous play surface when said insert is mounted therein.

* * * * *